US005578979A

United States Patent [19]

Adams et al.

[11] Patent Number: 5,578,979

[45] Date of Patent: Nov. 26, 1996

[54] ELECTROMAGNETIC APPARATUS

[75] Inventors: David M. Adams, Mequon; Jerome K. Hastings, Sussex, both of Wis.

[73] Assignee: Eaton Corporation, Cleveland, Ohio

[21] Appl. No.: 1,388

[22] Filed: Jan. 6, 1993

[51] Int. Cl.[6] ..... H01F 7/10

[52] U.S. Cl. ..... 335/245

[58] Field of Search ..... 335/104, 245, 335/247; 310/172

[56] References Cited

U.S. PATENT DOCUMENTS

| | | |
|---|---|---|
| 2,053,129 | 9/1936 | Chapman . |
| 3,283,275 | 11/1966 | Rider, Jr. . |
| 4,030,056 | 6/1977 | Patz . |
| 4,525,694 | 6/1985 | Dennison et al. . |
| 4,760,364 | 7/1988 | Ostby . |

FOREIGN PATENT DOCUMENTS

| | | | |
|---|---|---|---|
| 180615 | 12/1954 | Austria | 335/245 |
| 390541 | 12/1908 | France | 335/245 |
| 1073586 | 1/1960 | Germany . | |
| 1107825 | 5/1961 | Germany | 335/245 |
| 2621562 | 11/1977 | Germany | 335/245 |
| 183103 | 7/1989 | Japan | 335/245 |
| 663737 | 12/1951 | United Kingdom | 335/245 |
| 967992 | 8/1964 | United Kingdom | 335/245 |
| 1115589 | 5/1968 | United Kingdom | 335/245 |

OTHER PUBLICATIONS

CRC, Handbook of Chemistry & Physics, 1992, pp. 15–30, 31: Brazing Filler Metals (Solders).

*Primary Examiner*—Brian W. Brown
*Assistant Examiner*—Raymond Barrena
*Attorney, Agent, or Firm*—Tarolli, Sundheim, Covell, Tummino & Szabo

[57] ABSTRACT

An improved electromagnetic apparatus includes a core and an armature which is movable relative to the core. A shading ring is connected with the core to provide magnetic flux which is out of phase with magnetic flux from the core. The shading ring includes a base formed a first metal and a layer of a second metal clad to the base. The first metal forming the base work hardens and has a greater resistance to fatigue failure induced by vibration than the second metal of the layer which is clad to the base. However, the second metal forming the clad layer has a greater electrical conductivity than the first metal of the base. The base may be formed of aluminum and the layer of metal clad to the base may be formed of copper. The layer of copper may be clad to the base by an extrusion process.

4 Claims, 3 Drawing Sheets

ELECTROMAGNETIC APPARATUS

BACKGROUND OF THE INVENTION

The present invention relates to a new and improved electromagnetic apparatus and more particularly to an electromagnetic contactor having a core with a shading ring.

Electromagnetic contactors commonly have a laminated metal core with a shading ring. The shading ring provides magnetic flux which is out of phase with magnetic flux from the core. The use of the shading ring diminishes chattering or noise during operation of the contactor under the influence of an alternating current. Electromagnetic contactors having cores with shading rings are disclosed in U.S. Pat. Nos. 2,053,129; 3,283,275; 4,030,056; 4,525,694; and 4,760,364.

Copper shading rings have a relatively short operating life. This is due to fatigue fracture of the copper shading rings under the influence of mechanical vibration. However, copper shading rings have a high conductivity and, for that reason, the relatively short operating life of copper shading rings has been tolerated. In an effort to increase shading ring operating life, U.S. Pat. No. 2,053,129 suggests forming a shading ring of a copper-beryllium alloy.

SUMMARY OF THE INVENTION

The present invention relates to an electromagnetic apparatus having a core and an armature which is movable relative to the core. A shading ring is connected with the core to provide magnetic flux which is out of phase with magnetic flux from the core. The shading ring includes a base and a layer of metal which is clad or bonded to the base. The metal forming the base has greater resistance to fatigue failure induced by vibration than the metal which is clad to the base. However, the metal which is clad to the base has a greater electrical conductivity than the metal forming the base.

In one embodiment of the invention, the base was formed of aluminum and the metal clad to the base was formed of copper. It is presently preferred to form the shading ring by an extrusion process in which the layer of copper is deposited on an outer side surface of the aluminum base of the shading ring.

BRIEF DESCRIPTION OF THE DRAWINGS

The foregoing and other features of the invention will become apparent upon a consideration of the following description taken in connection with the accompanying drawings wherein.

DESCRIPTION OF A PREFERRED EMBODIMENT OF THE INVENTION

Figure 1:
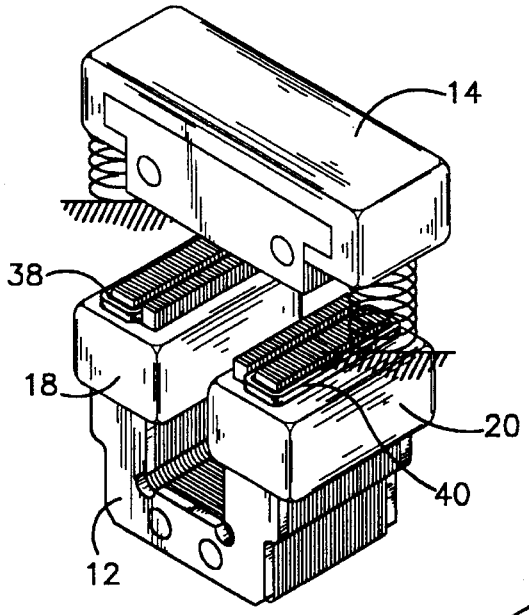
FIG. 1 is a schematic illustration of an electromagnetic apparatus constructed in accordance with the present invention.

An electromagnetic apparatus 10 is illustrated schematically in FIG. 1. The electromagnetic apparatus 10 includes a stationary core 12 and an armature 14 which is movable toward and away from the core. A plurality of coils 18 and 20 are provided in association with the core. By energization of the coils 18 and 20, magnetic flux flows from the core 12 to the armature 14 to pull the armature toward the core in a known manner. Although the electromagnetic apparatus 10 has been illustrated schematically in FIG. 1, it is contemplated that the electromagnetic apparatus may advantageously have a construction which is the same as or similar to the construction of the electromagnet of the electromagnetic contactor disclosed in U.S. Pat. No. 4,760,364. Of course, the electromagnetic apparatus 10 could have a different construction if desired.

Figure 2:
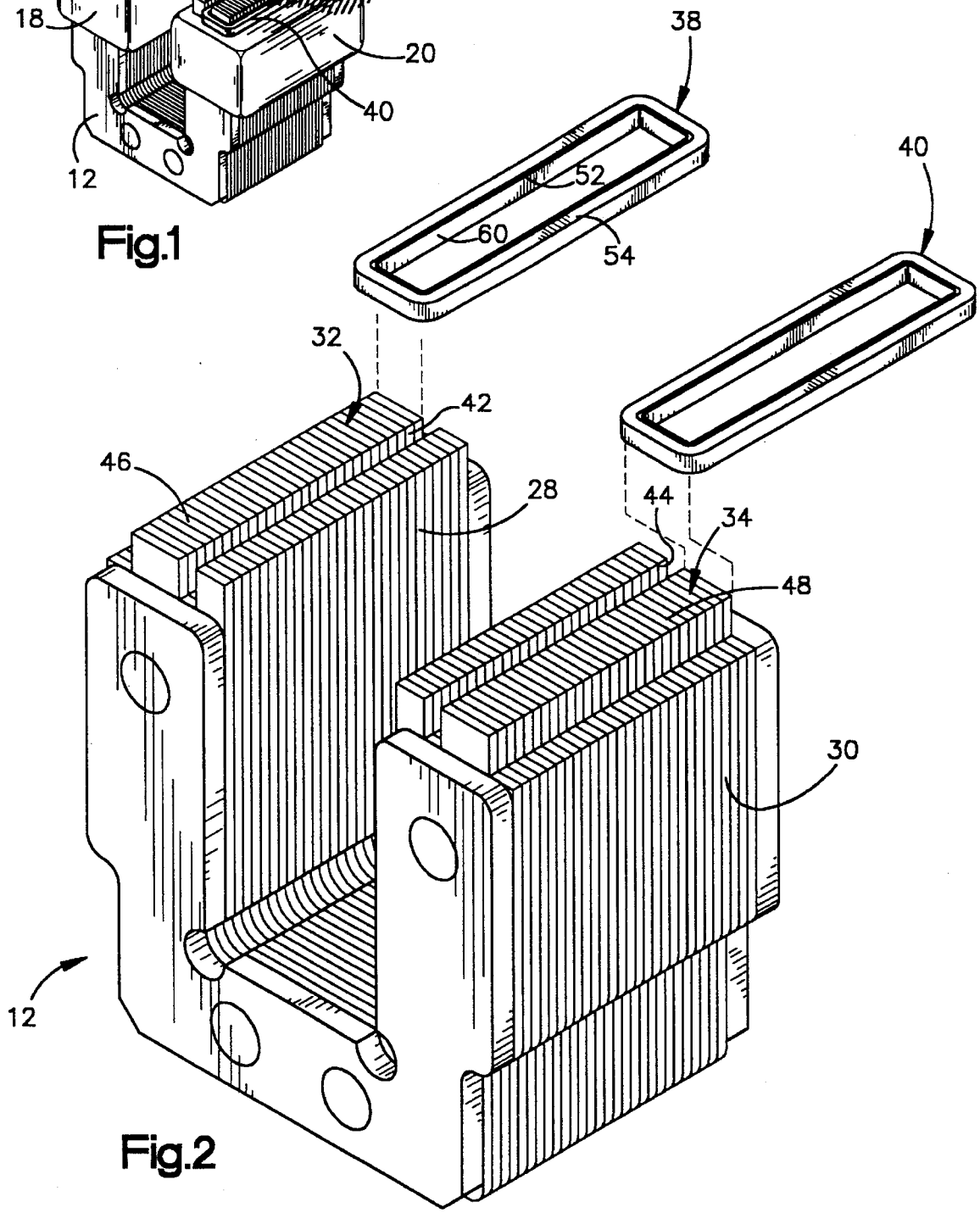
FIG. 2 is an exploded view of a core and a plurality of shading rings used in the electromagnetic apparatus of FIG. 1.

The laminated metal core 12 (FIG. 2) has a generally U-shaped configuration. The generally U-shaped laminated metal core 12 includes a pair of pole pieces or sections 28 and 30. Upper (as viewed in FIG. 2) surfaces 32 and 34 of the pole pieces 28 and 30 form a pair of parallel pole faces which are engaged by the armature 14.

A pair of shading rings 38 and 40 are received in parallel grooves or slots 42 and 44 formed in the pole faces 32 and 34. During operation of the electromagnetic apparatus 10, the shading rings 38 and 40 provide magnetic flux fields which are out of phase with a magnetic flux field provided by the core 12. The out of phase magnetic flux fields provided by the shading rings 38 and 40 tends to minimize vibration of the armature 14 during energization of the coils 18 and 20 by the alternating current power source.

The shading rings 38 and 40 circumscribe rectangular sections 46 and 48 of the pole faces 32 and 34. The general construction of the core 12 and the manner in which the shading rings are disposed on the pole pieces is well known. The core 12 could have a different construction and the shading rings 38 and 40 could be mounted in any desired manner on the pole faces 32 and 34.

In accordance with a feature of the present invention, the identical shading rings 38 and 40 are formed of two different metals, that is a first or base metal having a relatively high vibrational fatigue strength and a second metal which has a relatively high electrical conductivity. The second metal is clad or otherwise bonded to the base metal. The layer of metal which is clad to the base metal has less vibrational fatigue strength than the base metal. However, the combination of the base metal having a relatively high degree of vibrational fatigue strength and the layer of clad metal having a relatively high electrical conductivity results in the shading rings 38 and 40 having a relatively long service life and a relatively strong magnetic flux field.

The shading ring 38 (FIG. 3) includes a base 52 to which a layer 54 of metal is clad. The base 52 is formed of a metal having a relatively high resistance to fatigue fracture when the metal is subjected to severe vibration over a long period of time. The clad layer 54 is formed of a metal having a relatively high electrical conductivity to enable electrical current to be readily induced in the layer 54 by changes in the flux field from the core 12.

Although the base 52 and the clad layer 54 could be formed of many different metals, in one specific embodiment of the invention, the base 52 was formed of aluminum and the clad layer 54 was formed of copper. The aluminum base 52 has a relatively high resistance to vibrational fatigue fracture. This is because the aluminum base 52 work hardens when exposed to vibrational stresses. However, the aluminum base 52 has a relatively low electrical conductivity, compared to copper.

The clad copper layer 54 has a relatively high electrical conductivity, compared to aluminum. Therefore, the amount of electrical current which is induced in the clad copper layer 54 when the magnetic flux field of the core 12 changes, is greater that it would be if the clad layer was formed of aluminum.

The relatively high resistance of aluminum to vibrational fatigue failure is shown by the endurance limit for aluminum being approximately 12,000 pounds per square inch for annealed aluminum and approximately 23,000 pounds per square inch for work hardened aluminum. The fatigue strength of copper is approximately 11,000 to 14,000 pounds per square inch. The source of the preceding strength characteristics for copper and aluminum was Materials Selector 1992 published by Material Engineering Publication.

The relatively high electrical conductivity of copper is shown by its resistivity of approximately $1.7\times10^{-6}$ ohms per centimeter. The low electrical conductivity of aluminum is shown by its resistivity of approximately $2.8\times10^{-6}$ ohms per centimeter. Thus the electrical conductivity of copper is approximately 60 per cent greater than the conductivity of aluminum.

The combination of the work hardenable aluminum base 52 and clad copper layer 54 enhances the operating characteristics of the shading ring 38. The aluminum base 52 work hardens and increases in strength as a result of being exposed to vibrational stress during operation of the electromagnetic apparatus 10. Thus, the aluminum base 52 results in the shading ring 38 being able to withstand severe vibrations during operation of the electromagnetic apparatus 10 for a relatively large number of operating cycles. The copper layer 54 bonded to the aluminum base 52 enables the shading ring 38 to provide a strong magnetic flux field to promote quiet operation of the electromagnetic apparatus 10.

Figure 4:
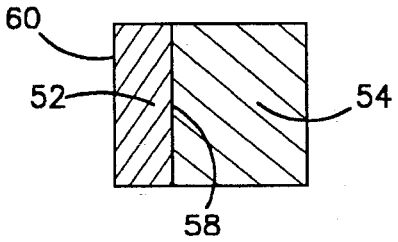
FIG. 4 is a sectional view, taken generally along the lines 4—4 of FIG. 3 and illustrating the relationship between a base of the shading ring and a layer of metal clad to the base of the shading ring.

It is preferred to form the shading ring 38 by an extrusion process. During the extrusion process, the clad layer 54 is bonded to an outer side surface 58 (FIG. 4) of the base 52. Thus, the base 52 has an outer side surface 58 which extends parallel to, an inner side surface 60. The inner side surface 60 faces toward a central axis of the shading ring 38 while the outer side surface 58 faces away from the central axis of the shading ring. During the simultaneous extrusion of the base 52 and the clad layer 54, the clad layer is firmly connected with the outer side surface 58 of the base by metallic/mechanical bonding between the clad layer and the base 52.

Figure 5:
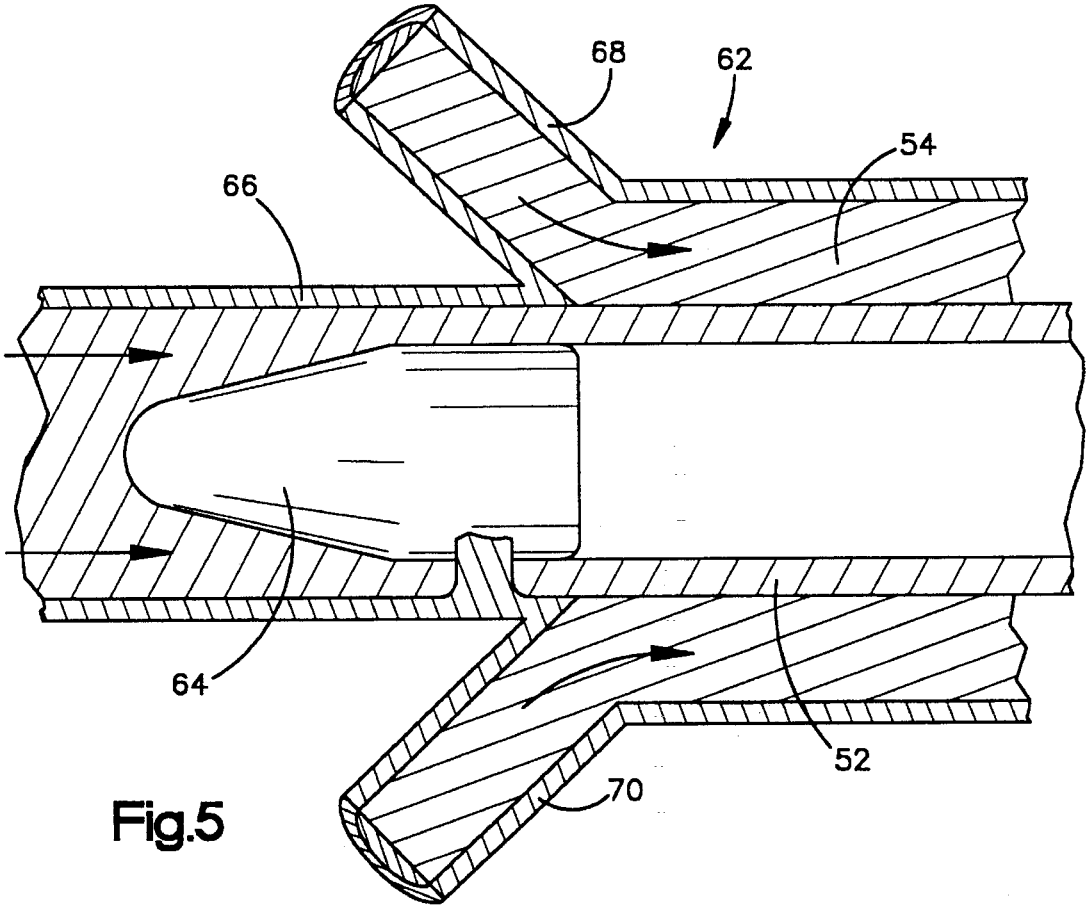
FIG. 5 is a schematic illustration depicting the manner in which the shading ring is formed by an extrusion process.

The manner in which the shading ring 38 is formed by an extrusion process is illustrated schematically in FIG. 5. Extrusion apparatus 62 includes a mandrel 64 which is surrounded by a tubular die or housing 66. Molten aluminum is extruded around the mandrel 64 to form the base 52. Molten copper is supplied through the conduits 68 and 70 and is extruded around the outside of the aluminum to form the clad layer 54.

Figure 3:
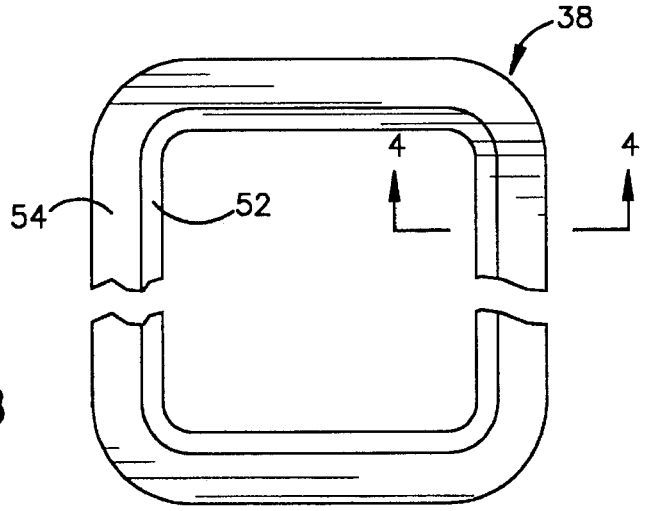
FIG. 3 is an enlarged plan view of one of the shading rings of FIG. 2.
Figure 6:
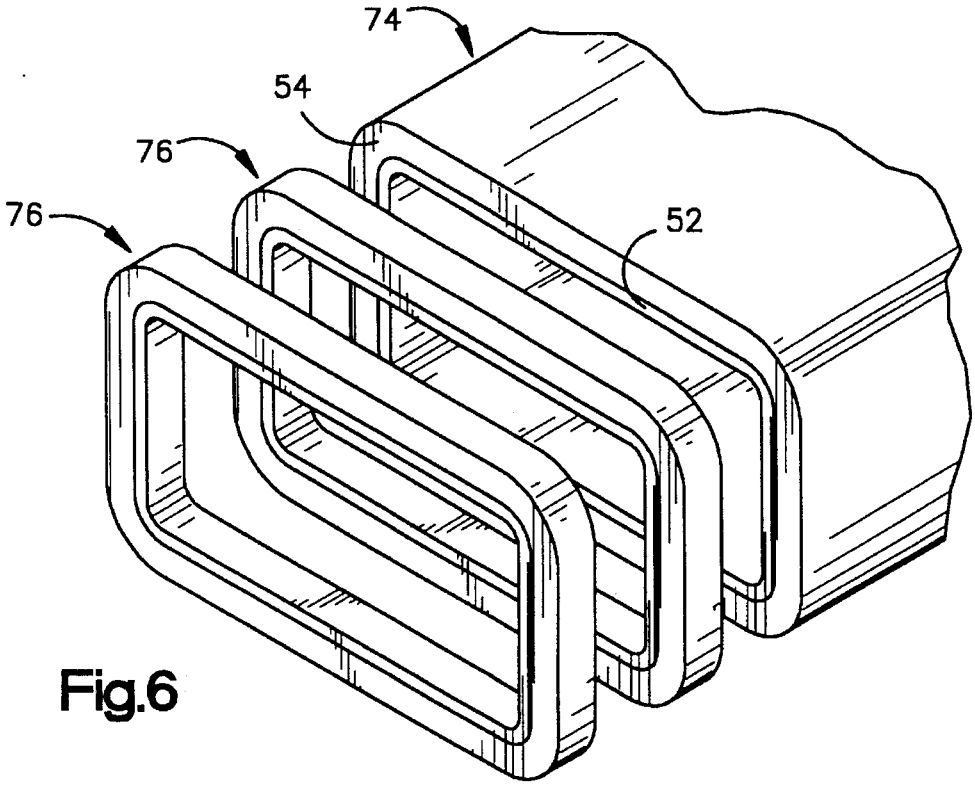
FIG. 6 is a schematic illustration depicting the manner in which an extruded tube is sliced to form shading rings.

The output from the extrusion apparatus 62 is a tube 74 (FIG. 6) having a cross sectional configuration corresponding to the configuration of the shading ring 38 (FIG. 3). The outside of the tube 74 is formed by the copper layer 54. The inside of the tube is formed by the aluminum base 52.

The tube 74 is sliced to form segments 76 having a thickness corresponding to the desired thickness of the shading rings 38 and 40. Thus, tube. 74 formed by the extrusion apparatus 62 had an axial extent which is substantially greater than the axial extent of the shading rings 38 and 40. The tube 74 is transversely sliced to form segments 76 having a thickness which is the same as the desired thickness of the shading rings 38 and 40.

Although it is preferred to bond the copper layer 54 to the outside of the aluminum base 52, it is contemplated that the copper layer could be bonded to the inside of the aluminum base if desired. It is also contemplated that the copper layer 54 could, if desired, completely enclose the aluminum base 52 of the shading ring 38. The relative thicknesses of the base 52 and copper layer 54 (FIG. 4) will depend upon the desired operating characteristics for the shading ring 38.

In the embodiment of the invention shown in FIGS. 1–6, the shade rings 38 and 40 have been formed with the aluminum base 52 and copper layer 54 extending in an axial direction relative to the shade rings. Thus, tube 74 (FIG. 6) has a tubular inner layer or base 52 formed of work hardenable aluminum which is enclosed by an axially extending outer layer 54 formed of copper. In the embodiment of the invention illustrated in FIGS. 7 and 8, the shading ring is formed with an axially layered construction rather than a circumferentially layered construction. Since the embodiment of the invention illustrated in FIGS. 7 and 8 is generally similar to the embodiment of the invention illustrated in FIGS. 1–6, similar numerals will be utilized to designate similar components, the suffix letter "a" being used in association with the embodiment of the invention illustrated in FIGS. 7 and 8 to avoid confusion.

A shading ring **38*a* (FIGS. 7 and 8) includes a base 52*a* to which a layer 54*a* of metal is clad. The base 52*a* is formed of a metal having a relatively high resistance to fatigue fracture when the metal is subjected to severe vibration over a long period of time. The clad layer 54*a* is formed of a metal having a relatively high electrical conductivity to enable electrical current to be readily induced in the layer 54*a*** by changes in a flux field from the core of a electromagnetic apparatus.

Figure 7:
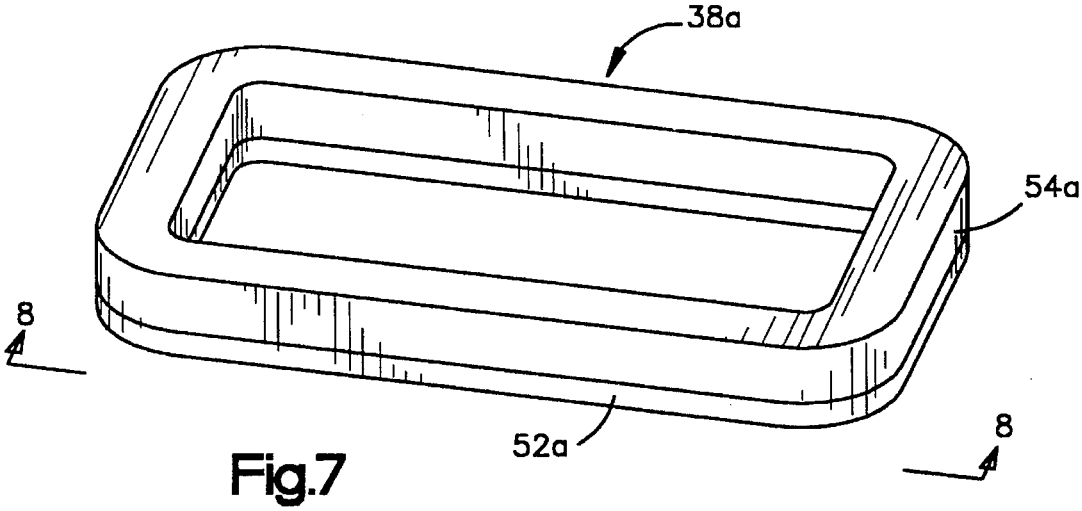
FIG. 7 is a schematic pictorial illustration of a second embodiment of the shading ring.
Figure 8:
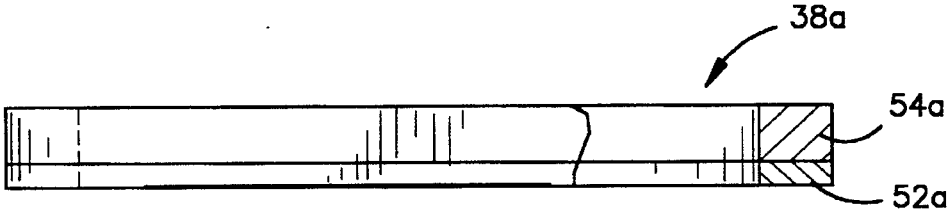
FIG. 8 is a partially broken away view, taken generally along the line 8—8 of FIG. 7, further illustrating the construction of the second embodiment of the shading ring.

In the embodiment of the invention illustrated in FIGS. 7 and 8, the base **52*a* is formed of aluminum and the clad layer 54*a* is formed of copper. The aluminum base 52*a* has a relatively high resistance to vibrational fatigue fracture. This is because the aluminum base 52*a* work hardens when exposed to vibrational stresses caused by operation of the electromagnetic apparatus which the shading ring 38*a*** is installed.

The clad copper layer **54*a* has a relatively high electrical conductivity compared to aluminum. Therefore, the amount of electrical current which is induced into the clad copper layer 54*a* when the magnetic flux field of the core of an electromagnet changes, is greater than it would be if the clad layer 54*a* was formed of aluminum. A combination of the work hardenable aluminum base 52*a* and electrically conducted clad copper layer 54*a* results in the shading ring 38*a*** being able to withstand severe vibrations and being able to provide a relatively strong magnetic field during operation of an electromagnetic apparatus in which the shading ring is installed.

In view of the foregoing, it is apparent that the present invention provides a new and improved electromagnetic apparatus 10 having a core 12 and an armature 14 which is movable relative to the core. Shading rings 38 and 40 are connected with the core 12 to provide magnetic flux which is out of phase with a magnetic flux from the core. The shading ring 38 includes a base 52 and a layer 54 of metal which is clad or bonded to the base. The metal forming the base 52 has greater resistance to fatigue failure induced by vibration than the metal which is clad to the base. However, the metal which is clad to the base 52 has a greater electrical conductivity than the metal forming the base.

In one embodiment of the invention, the base 52 was formed of aluminum and the metal clad to the base was formed of copper. It is presently preferred to form the shading ring 38 or 40 by an extrusion process in which the layer of copper is deposited on an outer side surface of the aluminum base of the shading ring.

Having described the invention, the following is claimed:

1. An electromagnetic apparatus comprising a core, an armature movable relative to said core, and shading ring means connected with said core, said shading ring means including a base formed of a first metal and a layer of a second metal clad to said base, said first metal being formed of a material which work hardens and has a greater resistance to fatigue failure induced by vibration than said second metal, said second metal having a greater electrical conductivity than said first metal.

2. An apparatus as set forth in claim 1 wherein said base is formed substantially of aluminum and said layer of metal clad to said base is formed substantially of copper.

3. An apparatus as set forth in claim 1 wherein one of said first and second metals is formed substantially of aluminum and the other of said first and second metals is formed substantially of copper.

4. An apparatus as set forth in claim 1 wherein said shading ring means is formed by segments severed from an extruded tubular member.

* * * * *